US009174824B2

(12) United States Patent
Tokura

(10) Patent No.: US 9,174,824 B2
(45) Date of Patent: Nov. 3, 2015

(54) ELEVATOR SYSTEM HAVING REMOTE CALL REGISTRATION REQUEST

(75) Inventor: Sakurako Tokura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 807 days.

(21) Appl. No.: 13/508,063

(22) PCT Filed: Dec. 24, 2009

(86) PCT No.: PCT/JP2009/071500

§ 371 (c)(1),
(2), (4) Date: May 4, 2012

(87) PCT Pub. No.: WO2011/077537

PCT Pub. Date: Jun. 30, 2011

(65) Prior Publication Data

US 2012/0211309 A1 Aug. 23, 2012

(51) Int. Cl.
*B66B 1/20* (2006.01)
*B66B 1/46* (2006.01)
(Continued)

(52) U.S. Cl.
CPC ..... *B66B 1/468* (2013.01); *B66B 1/2408* (2013.01); *B66B 3/002* (2013.01); *B66B 2201/103* (2013.01); *B66B 2201/232* (2013.01); *B66B 2201/4676* (2013.01)

(58) Field of Classification Search
CPC ..... B66B 1/468; B66B 1/2408; B66B 3/002; B66B 2201/103; B66B 2201/232; B66B 2201/4676
USPC ..... 187/247, 380–389, 391, 393, 396
See application file for complete search history.

(56) References Cited

U.S. PATENT DOCUMENTS 5,689,094 A 11/1997 Friedli et al.
7,328,775 B2 * 2/2008 Zaharia et al. ..... 187/396
(Continued)

FOREIGN PATENT DOCUMENTS

EP 1 958 908 A1 8/2008
JP 8 81143 3/1996
(Continued)

OTHER PUBLICATIONS

Combined Office Action and Search Report issued Sep. 29, 2013 in Chinese Patent Application No. 200980163057.0 with partial English translation and English translation of categories of cited documents.
(Continued)

*Primary Examiner* — Anthony Salata
(74) *Attorney, Agent, or Firm* — Oblon, McClelland, Maier & Neustadt, L.L.P.

(57) ABSTRACT

An elevator system includes a group control device controlling a plurality of elevators as a group, a security gate mounted with a personal identification device that identifies a passing user and issues identification information, an access control device that issues validation information based on the information about the user included in the identification information, a communication device transmitting a service floor call registration request for each user to the group control device based on the validation information, an assignment controlling function that is provided on the group control device to determine the elevator assigned pursuant to the service floor call registration request for each user, and issue assigned elevator information for each user, and an assigned elevator notification device installed on the security gate to notify each user of the assigned elevator information.

4 Claims, 5 Drawing Sheets

(51) Int. Cl.
*B66B 3/00* (2006.01)
*B66B 1/24* (2006.01)

(56) References Cited

U.S. PATENT DOCUMENTS

| | | | | |
|---|---|---|---|---|
| 7,353,915 | B2 * | 4/2008 | Zaharia et al. | 187/388 |
| 7,581,622 | B2 * | 9/2009 | Amano | 187/384 |
| 7,849,974 | B2 * | 12/2010 | Stanley et al. | 187/387 |
| 7,918,321 | B2 * | 4/2011 | Sakurai | 187/382 |
| 8,061,485 | B2 * | 11/2011 | Finschi | 187/384 |
| 8,162,109 | B2 * | 4/2012 | Amano | 187/382 |
| 8,439,169 | B2 * | 5/2013 | Iio et al. | 187/387 |
| 8,464,840 | B2 * | 6/2013 | Flynn et al. | 187/384 |
| 8,910,752 | B2 * | 12/2014 | Furutani | 187/384 |
| 2008/0196979 | A1 | 8/2008 | Sakurai | |
| 2009/0020372 | A1 | 1/2009 | Amano | |
| 2012/0097486 | A1 * | 4/2012 | Suzuki et al. | 187/384 |
| 2013/0068568 | A1 * | 3/2013 | Nonami | 187/381 |
| 2013/0068569 | A1 * | 3/2013 | Nakashima | 187/389 |

FOREIGN PATENT DOCUMENTS

| | | |
|---|---|---|
| JP | 11-349238 A | 12/1999 |
| JP | 2003 104633 | 4/2003 |
| JP | 2004 331337 | 11/2004 |
| JP | 3658007 | 6/2005 |
| JP | 2006 117398 | 5/2006 |
| JP | 2007 314280 | 12/2007 |
| JP | 2007 320758 | 12/2007 |
| WO | 2006 043324 | 4/2006 |

OTHER PUBLICATIONS

International Search Report Issued May 18, 2010 in PCT/JP09/71500 Filed Dec. 24, 2009.

Extended European Search Report issued Nov. 7, 2014 in Patent Application No. 09852554.6.

English Translation of the International Preliminary Report on Patentability issued Jul. 12, 2012, in PCT/JP2009/071500, filed Dec. 24, 2009.

English Translation of the Written Opinion of the International Searching Authority issued May 18, 2010, in PCT/JP2009/071500, filed Dec. 24, 2009.

Office Action issued Jul. 30, 2013 in Japanese Patent Application No. 2011-547151 (with English language translation).

Office Action issued Jul. 29, 2013 in Korean Patent Application No. 10-2012-7012502 (with English language translation).

* cited by examiner

10: SECURITY GATE
11: PERSONAL IDENTIFICATION DEVICE
12: ASSIGNED ELEVATOR NOTIFICATION DEVICE
20: ACCESS CONTROL DEVICE
21: VALIDATION INFORMATION TRANSMITTING FUNCTION
30: COMMUNICATION DEVICE
31: SERVICE FLOOR CALL REGISTERING FUNCTION
40: GROUP CONTROL DEVICE
41: ASSIGNMENT CONTROLLING FUNCTION
50: ELEVATOR CONTROL DEVICE
51: CAR CONTROLLING FUNCTION

90: IDENTIFICATION CALL REGISTRATION DEVICE
12: ASSIGNED ELEVATOR NOTIFICATION DEVICE
11: PERSONAL IDENTIFICATION DEVICE

40: GROUP CONTROL DEVICE
41: ASSIGNMENT CONTROLLING FUNCTION
42: DISTANCE DATA STORAGE

ELEVATOR SYSTEM HAVING REMOTE CALL REGISTRATION REQUEST

TECHNICAL FIELD

The present invention relates to an elevator system.

BACKGROUND ART

As a conventional elevator system, there has been known a system, in which, to enhance the security and to improve the operation efficiency, an elevator group control device for controlling a plurality of elevators as one group is provided; a validation device is mounted at a security gate provided at the building entrance; and after this validation device has accomplished validation, the security gate is opened to allow the user to move into an elevator hall on an entrance floor, including a validation information transmitting means for transmitting validation information to a corresponding bank among a plurality of banks in the elevator hall based on destination floor validation information of the validation device; a car assigning means for assigning a car to each destination floor of passenger based on the validation information; and a service floor displaying means for displaying service floors for each assigned car in the entrance floor hall, wherein an operation inherent in the user (for example, a disabled person operation) based on the individual validation information of the validation device is selected, or the car is caused to wait, while the car door is open, in the hall in the case where the distance from the security gate to the hall is long (for example, refer to Patent Literature 1).

Also, there have conventionally been known a system in which information including a desired destination floor is stored in a card-type information transmitter carried by the user; the destination floor information is transmitted from this card-type information transmitter to a recognition device via wireless communication, whereby a call registration is made based on this destination floor information; and the result of assignment to this call registration is displayed on a display or the like provided near an input device such as a ten-key pad provided in a hall to make call registration (for example, refer to Patent Literature 2), and a system in which when a sensor of an entrance gate provided so as to correspond to each zone including a plurality of floors detects a user, the call to the zone corresponding to that entrance gate is registered, and the assignment result is displayed for the user at the outlet of the entrance gate (for example, refer to Patent Literature 3).

CITATION LIST

Patent Literature

Patent Literature 1: International Publication No. WO2006/043324

Patent Literature 2: Japanese Patent Laid-Open No. 08-081143

Patent Literature 3: Japanese Patent No. 3658007

SUMMARY OF INVENTION

Technical Problem

Unfortunately, the conventional elevator system described in Patent Literature 1 has a problem that since the car is assigned for each destination floor based on the destination floor validation information of the validation device at the security gate, for example, in the case where a special operation inherent in the user is selected based on the personal information, an optimum car cannot always be assigned for each user individual.

Also, this elevator system has problems that since the service floor is displayed in the entrance floor hall for each assigned car, the user does not understand which is the car assigned to his/her desired destination floor until he/she arrives at the hall, and that in the hall, the user must look for the car assigned to his/her desired destination floor from the display.

Further, this elevator system also has a problem that since the car is caused to wait, while the car door is open, in the hall in the case where the distance from the security gate to the hall is long, the number of cars waiting while the car door is open increases, so that the operation efficiency of elevator suffers.

The present invention has been made to solve the above problems, and accordingly a first object thereof is to provide an elevator system capable of assigning a car that is optimum for each user individual considering the user's personal information, and capable of improving the operation efficiency while the security and convenience are assured.

Also, a second object thereof is to provide an elevator system in which the user can easily know a car on which he/she is supposed to ride.

Means for Solving the Problems

The present invention is an elevator system which has a group control device for controlling a plurality of elevators as a group; and a security gate which is provided at a place connecting to an elevator hall for the elevators, and is mounted with a personal identification device which identifies the passing user and issues identification information, comprising: an access control device which issues validation information based on the information about the user included in the identification information; a communication device which transmits a service floor call registration request for each user to the group control device based on the validation information; an assignment controlling function which is provided on the group control device to determine the elevator assigned pursuant to the service floor call registration request for each user, and issue assigned elevator information for each user; and an assigned elevator notification device which is installed on the security gate or near the security gate to notify each user of the assigned elevator information.

Advantageous Effects of Invention

The elevator system in accordance with the present invention achieves effects that a car that is optimum for each user individual considering the personal information about the user can be assigned, and that the operation efficiency can be improved while the security and convenience are assured.

Also, the elevator system in accordance with the present invention additionally achieves an effect that the user can easily know a car on which he/she is supposed to ride.

DESCRIPTION OF EMBODIMENTS

Figure 1:
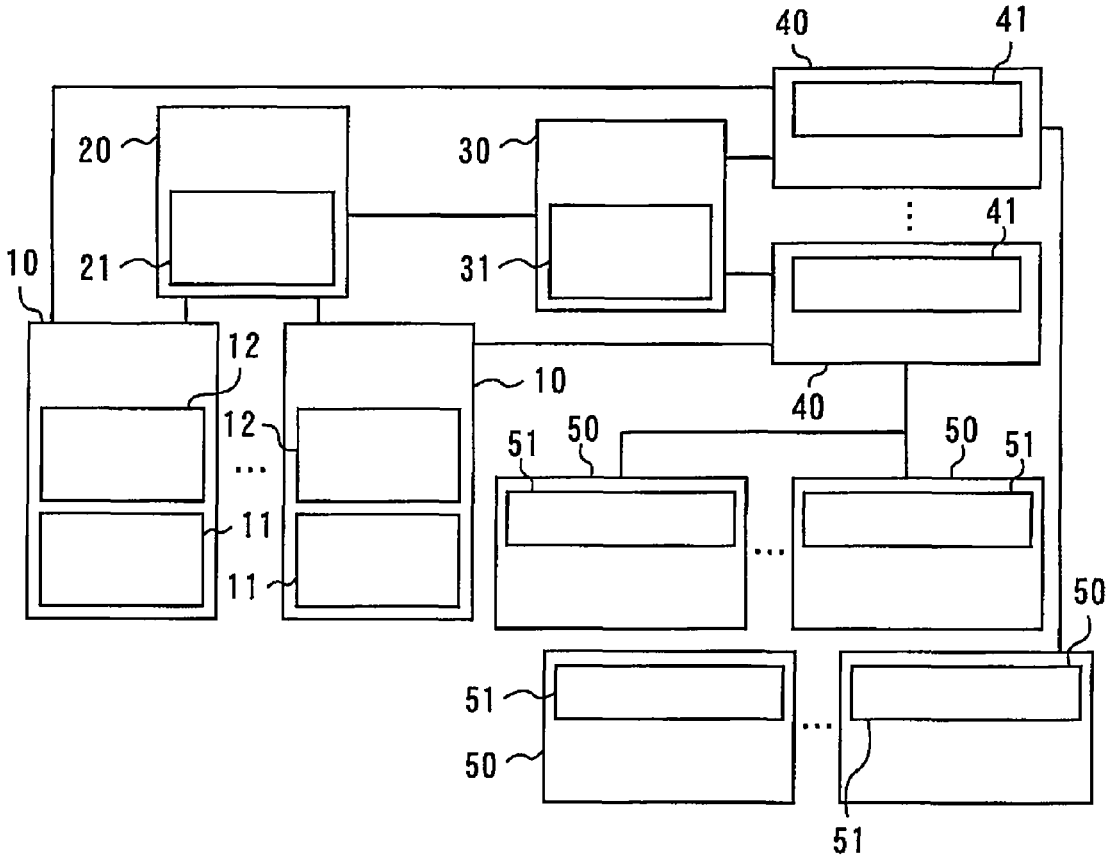
FIG. 1 is a block diagram showing the configuration of an elevator system related to Embodiment 1 of the present invention.

The present invention will now be described with reference to the accompanying drawings. In the drawings, the same reference signs are applied to the same or equivalent parts, and the duplicated explanation thereof is simplified or omitted as appropriate.

First embodiment

Figure 2:
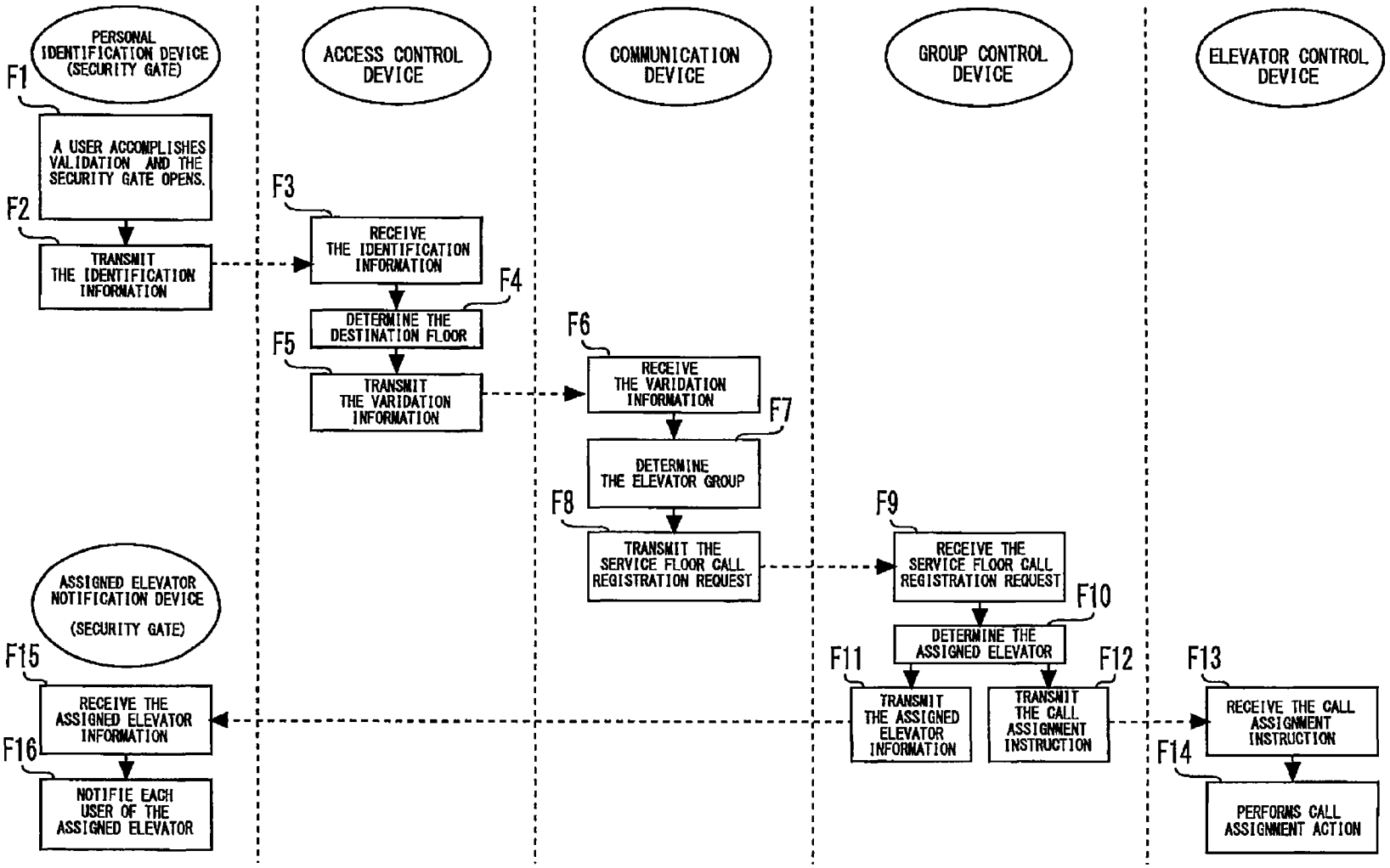
FIG. 2 is a flow diagram showing the flow of processing carried out by an elevator system related to Embodiment 1 of the present invention.
Figure 3:
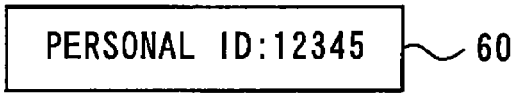
FIG. 3 is a view showing one example of identification information related to Embodiment 1 of the present invention.
Figure 4:
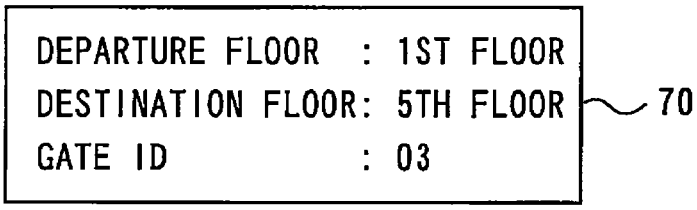
FIG. 4 is a view showing one example of validation information related to Embodiment 1 of the present invention.
Figure 8:
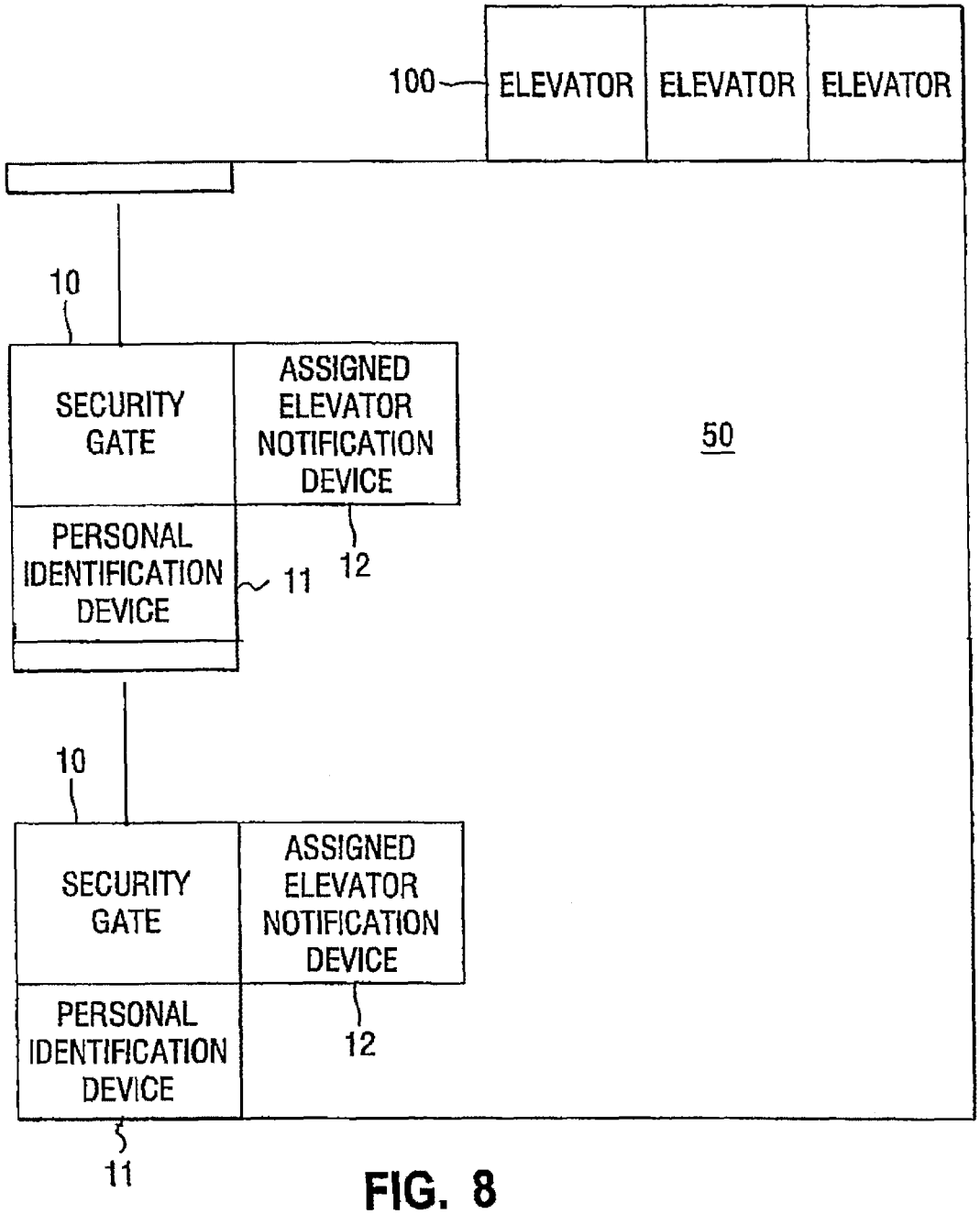
FIG. 8 shows the arrangement of the security gates to the elevator hall.

FIGS. 1 to 4 and 8 relate to a first embodiment of the present invention. FIG. 1 is a block diagram showing the configuration of an elevator system, FIG. 2 is a flow diagram showing the flow of processing carried out by an elevator system, FIG. 3 is a view showing one example of identification information, FIG. 4 is a view showing one example of validation information, and FIG. 8 shows the arrangement of the security gates to the elevator hall.

In FIG. 1, reference sign 10 denotes a security gate that is installed at a place connecting to an elevator hall 50. The security gate 10 judges by personal identification whether or not a user going to pass through has the authority to pass through, and inhibits the user having no authority from passing through.

This security gate 10 is mounted with a personal identification device 11 for making personal identification of a user going to pass through the security gate 10. This personal identification device 11 is composed of, for example, a contact-type or noncontact-type card reader for reading an ID card that the user has or one of various kinds of biometric devices (fingerprint, palm print, palm vein, iris, etc.).

The user going to pass through the security gate 10 makes validation by using the personal identification device 11. If the identification is OK, the security gate is opened to allow the user to pass through, and if the identification is NG, the security gate 10 is closed to inhibit the user from passing through. At this time, identification information 60 obtained by the identification is sent from the personal identification device 11. This identification information 60 includes the personal ID of the user who made validation, for example, as shown in FIG. 3.

On the security gate 10 itself or near the security gate 10, an assigned elevator notification device 12 for notifying the user of the assigned elevator is installed. This assigned elevator notification device 12 is composed of a display such as an LCD that displays images or character information, a speaker that sounds a voice, or the like.

The security gate 10 is connected to an access control device 20.

This access control device 20 receives the identification information 60 sent from the personal identification device 11 of the security gate 10, and determines the destination floor of the user relating to the identification information 60 based on the user information included in the identification information 60.

The access control device 20 has a validation information transmitting function 21 for transmitting validation information 70, which is information about the validation accomplished concerning that user. This validation information 70 includes the departure floor of that user, the determined destination floor, and the gate ID specifying the security gate 10 that the user passed through (validated).

The access control device 20 is connected to a communication device 30.

This communication device 30 has a service floor call registering function 31 that receives the validation information 70 sent from the validation information transmitting function 21 of the access control device 20, and transmits a service floor call registration request for each user based on the validation information 70.

The elevator system concerned is a group control elevator that controls a plurality of elevators 100 as a group, and can include a plurality of groups. The service floor call registering function 31 acquires position information of that security gate 10 from the gate ID of the validation information 70, determines an elevator group for which a service floor call should be registered among the plurality of elevator groups based on this position information, and transmits the service floor call registration request to a group control device 40 of the determined elevator group.

The group control device 40 carries out control of a group consisting of a plurality of elevators. In the case where the elevator system concerned consists of a plurality of elevator groups, the group control device 40 is provided for each of the elevator groups.

This group control device 40 has an assignment controlling function 41 that receives the service floor call registration request sent from the service floor call registering function 31 of the communication device 30, and determines the elevator assigned pursuant to the service floor call registration request for each user from the elevator group.

When the assigned car is determined in response to the service floor call registration request, this assignment controlling function 41 transmits assigned elevator information for each user to the assigned elevator notification device 12 of the security gate 10 at which identification, which is the basis of the service floor call registration, was made (through which the user passed), and issues a call assignment instruction.

The assigned elevator notification device 12 of the security gate 10 notifies each user of the assigned elevator based on the received assigned elevator information.

Each of the group control devices 40 is provided with an elevator control device 50, which controls each elevator belonging to the elevator group controlled by that group control device 40, so as to correspond to each elevator.

This elevator control device 50 has a car controlling function 51 for mainly carrying out operation control of the corresponding elevator. This car controlling function 51 receives the call assignment instruction from the assignment controlling function 41, causes the car to run to the departure floor based on this call assignment instruction, and performs call assignment action such that the call registration to the destination floor is made.

In this embodiment, the elevator system operates in accordance with a series of processing procedures shown in FIG. 2.

First, a user going to pass through the security gate 10 accomplishes validation on the personal identification device 11. In this validation, if the identification is OK, the security gate 10 is opened (F1).

Then, the personal identification device 11 transmits the identification information 60 obtained by this identification to the validation information transmitting function 21 of the access control device 20 (F2).

Next, the validation information transmitting function 21 of the access control device 20 receives the identification information 60 sent from the personal identification device 11 (F3), and determines the destination floor of the user relating to this identification information 60 based on the user information included in the identification information 60 (F4). Then, the validation information transmitting function 21 transmits the validation information 70 relating to that user to the service floor call registering function 31 of the communication device 30 (F5).

The service floor call registering function 31 of the communication device 30, which receives this validation information 70 (F6), acquires the position information of the security gate 10 through which that user passed, determines the elevator group for which service floor call should be registered among the plurality of elevator groups based on this position information (F7), and transmits the service floor call registration request for each user to the group control device 40 of the determined elevator group (F8).

The assignment controlling function 41 of the group control device 40 receives the service floor call registration request from the service floor call registering function 31 (F9), and determines the elevator assigned pursuant to this service floor call registration request from among the elevators belonging to the elevator group for each user (F10). Then, the assignment controlling function 41 transmits the assigned elevator information for each user to the assigned elevator notification device 12 of the security gate 10 at which identification, which is the basis of the service floor call registration, was made (through which the user passed) (F11), and issues the call assignment instruction to the elevator control device 50 that controls the assigned elevator (F12).

When this call assignment instruction is received (F13), the car controlling function 51 of the elevator control device 50 performs call assignment action based on this call assignment instruction (F14). Also, the assigned elevator notification device 12 of the security gate 10 receives the assigned elevator information from the assignment controlling function 41 (F15), and notifies each user of the assigned elevator based on this assigned elevator information (F16).

The elevator system configured as described above is an elevator system having a group control device for controlling a plurality of elevators as a group; and a security gate that is provided at a place connecting to an elevator hall for the elevators, and is mounted with a personal identification device that identifies the passing user and issues identification information, including an access control device that issues validation information based on the information about the user included in the identification information; a communication device for transmitting a service floor call registration request for each user to the group control device based on the validation information; an assignment controlling function that is provided on the group control device to determine the elevator assigned pursuant to the service floor call registration request for each user, and issue assigned elevator information for each user; and an assigned elevator notification device that is installed on the security gate or near the security gate to notify each user of the assigned elevator information.

Therefore, a car that is optimum for each user individual can be assigned considering the user's personal information, and the operation efficiency can be improved while the security and convenience are assured. Also, the user can easily know a car on which he/she is supposed to ride.

Second Embodiment

Figure 5:
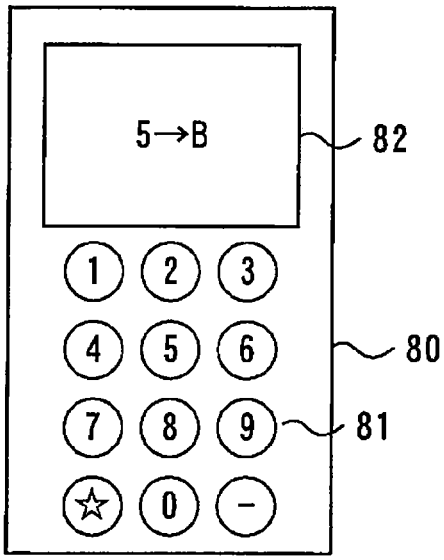
FIG. 5 is a view showing one example of a hall operating panel related to Embodiment 2 of the present invention.
Figure 6:
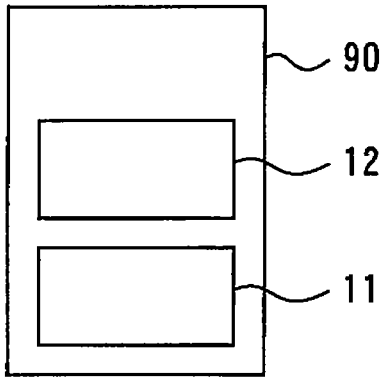
FIG. 6 is a view showing a configuration of an identification call registration device related to Embodiment 2 of the present invention.

FIGS. 5 and 6 relate to a second embodiment of the present invention. FIG. 5 is a view showing one example of a hall operating panel, and FIG. 6 is a view showing a configuration of an identification call registration device.

In the second embodiment described herein, in addition to the configuration in the above-described first embodiment, the configuration is made such that a service floor call registration device is installed in the elevator hall so that a call can be registered by using this service floor call registration device when the user forgets or misses his/her assigned elevator.

FIG. 5 shows a hall operating panel 80 provided in the elevator hall as one example of a service floor call registration device. This hall operating panel 80 includes a ten-key pad section 81 for the user to input his/her desired destination floor, and a display section 82 consisting of a display such as an LCD, which is the assigned elevator notification device 12 for notifying the user of the assigned elevator.

In the case where the user who has passed through the security gate 10 forgets to see, forgets, or misses the assigned elevator, this user performs the service floor call registering operation by using the ten-key pad section 81 of the hall operating panel 80. Then, the assignment controlling function 41 of the group control device 40, which receives the service floor call registration request from the hall operating panel 80, determines the assigned elevator in response to this service floor call registration by almost the same procedure as the above-described procedure in the first embodiment, transmits the assigned elevator information to the hall operating panel 80, and sends the call assignment instruction to the elevator control device 50.

The hall operating panel 80 displays the assigned elevator information in the display section 82 to notify the user of this information, and the car controlling function 51 of the elevator control device 50 performs call assignment action on receipt of the call assignment instruction.

Other configurations and operations are the same as those in the first embodiment, and the detailed explanation thereof is omitted.

As the service floor call registration device, an identification call registration device 90, in which a gate function is removed from the security gate 10, may be installed in the elevator hall. The identification call registration device 90 includes the personal identification device 11 and the assigned elevator notification device 12, and is connected to the access control device 20 and the group control device 40.

When the user accomplishes validation by using the personal identification device 11, the same processing operation as that at the time of passing through the security gate 10 in the first embodiment, except the fact that no gate function is provided, is performed, the service floor call is registered, and the user is notified of the assigned elevator information by using the assigned elevator notification device 12.

The elevator system configured as described above is an elevator system in which in the configuration of the first embodiment, the elevator system further includes a service floor call registration device that is provided in the elevator hall to make service floor call registration desired by the user.

Therefore, in addition to the fact that the same effect as that of the first embodiment can be achieved, the call can be reregistered by using the service floor call registration device when the user having passed through the security gate 10 forgets to see, forgets, or misses his/her assigned elevator.

Third Embodiment

Figure 7:
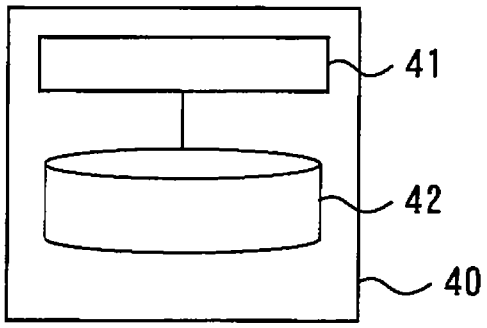
FIG. 7 is a view showing a configuration of the group control device related to Embodiment 3 of the present invention.

FIG. 7, which relates to a third embodiment of the present invention, is a view showing a configuration of the group control device.

In the third embodiment described herein, in addition to the configurations in the above-described first and second embodiments, the configuration is made such that the group control device includes a distance data storage that stores, in advance, the distances from the security gates to the elevator hall or the halls of elevators, and the group control device assigns the optimum car considering the movement time from when the user passes through the gate to when the user arrives at the elevator hall or the like based on the distance data.

That is, the group control device 40 includes a distance data storage 42 that stores, in advance, the distances from the security gates 10 to the elevator hall or the halls of elevators belonging to the elevator group controlled by the group control device 40.

When determining the assignment of elevator pursuant to the service floor call registration request, the assignment controlling function 41 of the group control device 40 acquires, from the distance data storage 42, distance information about the distance from the security gate 10 through which the user relating to the service floor call registration request passed to, for example, the elevator hall, and determines the assigned elevator capable of securing sufficient time for the user not to miss the assigned elevator considering the movement time from when the user passes through the security gate 10 to when the user arrives at the elevator hall based on the distance data.

Other configurations and operations are the same as those in the first and second embodiments, and the detailed explanation thereof is omitted.

The elevator system configured as described above is an elevator system in which in the configuration of the first or second embodiment, the group control device includes a distance data storage that stores, in advance, distance information about the distance from the security gate to the elevator hall; and the assignment controlling function determines the elevator assigned pursuant to the service floor call registration request for each user considering the movement time from when the user passes through the security gate to when the user arrives at the elevator hall based on the distance information in the distance data storage.

Therefore, in addition to the fact that the same effect as that of the first and second embodiments can be achieved, the user can be prevented from missing his/her assigned elevator, and also the operation efficiency of elevator can be improved by making the time during which the car waits while the car door is open a minimum.

INDUSTRIAL APPLICABILITY

The present invention can be applied to an elevator system in which a plurality of elevators are controlled as a group, and the personal identification of a user who passes through a security gate provided at a place connecting to an elevator hall is accomplished.

DESCRIPTION OF SYMBOLS

10 security gate
11 personal identification device
12 assigned elevator notification device
20 access control device
21 validation information transmitting function
30 communication device
31 service floor call registering function
40 group control device
41 assignment controlling function
42 distance data storage
50 elevator control device
51 car controlling function
60 identification information
70 validation information
80 hall operating panel
81 ten-key pad section
82 display section
90 identification call registration device

The invention claimed is:

1. An elevator system having a group control device for controlling a plurality of elevators as a group, comprising:

a plurality of security gates which is provided at a place connecting to an elevator hall for the elevators, and is mounted with a personal identification device which identifies the passing user and issues identification information, an access control device which issues validation information based on the information about the user included in the identification information, the validation information including a departure floor of the user, a determined destination floor, and a gate ID specifying the security gate that the user has been identified;

a communication device which transmits a service floor call registration request for each user to the group control device based on the validation information;

an assignment controlling function which is provided on the group control device to determine the elevator assigned pursuant to the service floor call registration request for each user, and issue assigned elevator information for each user; and an assigned elevator notification device which is installed on each of the security gates or near the security gate to notify each user of the assigned elevator information, wherein the assignment controlling function transmits the assigned elevator information for each user to the assigned elevator notification device of the security gate at which identification, which is the basis of the service floor call registration, was made.

2. The elevator system according to claim 1, wherein the elevator system further comprises a service floor call registration device which is provided in the elevator hall to make service floor call registration desired by the user.

3. The elevator system according to claim 1, wherein the group control device includes a distance data storage which stores, in advance, distance information about the distance from the security gates to the elevator hall; and the assignment controlling function determines the elevator assigned pursuant to the service floor call registration request for each user considering the movement time from when the user passes through the security gate which is the basis of the service floor call registration to when the user arrives at the elevator hall based on the distance information in the distance data storage.

4. The elevator system according to claim 2, wherein the group control device includes a distance data storage which stores, in advance, distance information about the distance from the security gates to the elevator hall; and the assignment controlling function determines the elevator assigned pursuant to the service floor call registration request for each user considering the movement time from when the user passes through the security gate which is the basis of the service floor call registration to when the user arrives at the elevator hall based on the distance information in the distance data storage.

* * * * *